United States Patent [19]

Geddings

[11] Patent Number: 4,787,123

[45] Date of Patent: Nov. 29, 1988

[54] OYSTER SHUCKING DEVICE

[76] Inventor: John E. Geddings, 221 W. Ridge Ct., Chapin, S.C. 29036

[21] Appl. No.: 179,571

[22] Filed: Apr. 8, 1988

[51] Int. Cl.[4] ..... A22C 29/04; A47G 21/06

[52] U.S. Cl. ..... 17/75

[58] Field of Search ..... 17/75, 74, 76, 66, 69; 30/356

[56] References Cited

U.S. PATENT DOCUMENTS 2,854,688 10/1958 Colangelo .

3,991,466 11/1976 Smith ..... 17/75 X 4,477,943 10/1984 Grush .

4,610,052 9/1986 Lubcke .

*Primary Examiner*—Willie G. Abercrombie

*Attorney, Agent, or Firm*—John E. McRae

[57] ABSTRACT

A device for separating the shells of an oyster and removing edible meat cleanly from one of the shells. A flat-surfaced blade is inserted into the hinged connection between the shells and then twisted around the blade axis to break the shells apart. The blade side edge has a convex oviform profile that enables the blade to slide under the edible meat in one of the shells, whereby the meat can be scooped out of the shell in one easy motion.

6 Claims, 1 Drawing Sheet

OYSTER SHUCKING DEVICE

BACKGROUND OF THE INVENTION

The invention relates to a device for separating the shells of an oyster, and removing the edible meat therefrom. The device is believed to be an improvement on devices shown in the prior art, e.g. U.S. Pat. No. 2,854,688 to V. Colangelo, U.S. Pat. No. 4,477,943 to R. Grush, and U.S. Pat. No. 4,610,052 to K. Tubcke.

SUMMARY OF THE INVENTION

The invention contemplates a manual implement comprising an elongated rod, and a flat blade extending from the rod, said blade having a thin blunt edge that can be inserted into a hinged connection between two shells of an oyster, after which the implement can be turned on the rod axis to enable the flat faces of the blade to break the hinged connection. The blade has at least one sharpened side edge that has a convex oviform profile conforming to the concave interior surface of an oyster shell containing edible meat. By drawing the blade along the shell interior surface it is possible for the blade sharpened edge to cleanly sever the meat from the shell.

THE DRAWINGS

DESCRIPTION OF A PREFERRED EMBODIMENT OF THE INVENTION

Figure 1:
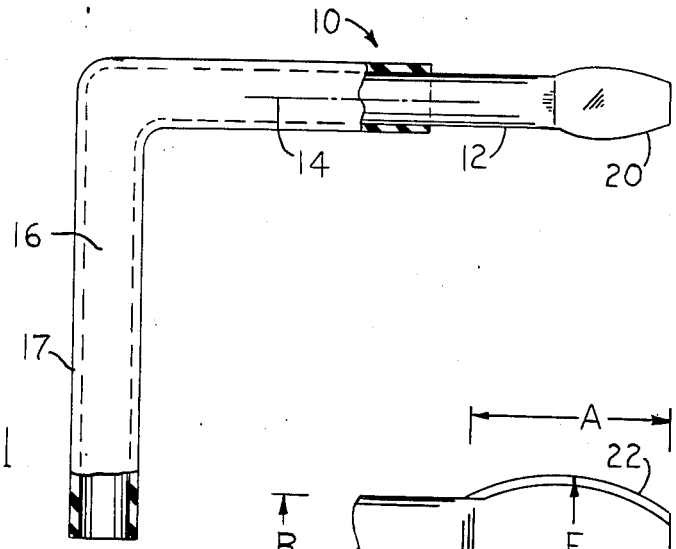
FIG. 1 is a side elevational view of a manual implement embodying my invention.

FIG. 1 shows a manual device 10 used to separate the shells of an oyster and remove edible meat from one shell. The device comprises a solid cylindrical rod 12 having a longitudinal axis 14. The left end of the rod is turned at right angles to form a handle 16. Preferred material for the rod is stainless steel. The hand grip portion of the rod is preferably encased in a rubber sleeve 17 having a desired non-slip friction outer surface.

Figure 2:
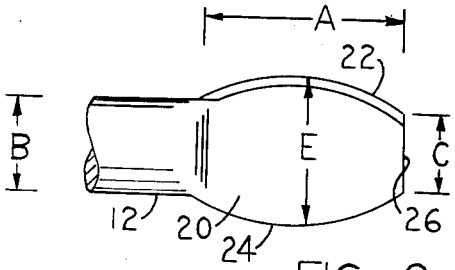
FIG. 2 is a fragmentary enlarged view of a blade structure forming part of the FIG. 1 implement.
Figure 3:
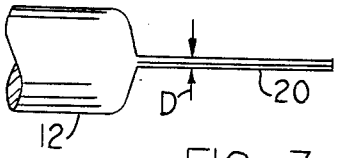
FIG. 3 is a top view of the FIG. 2 blade structure.

The right end of rod 12 is flattened to form a flat-surfaced blade 20. FIGS. 1 and 2 are taken looking toward the blade face. FIG. 3 is taken looking in the direction of the blade edge.

Blade 20 has a length dimension A that is greater than the cross-sectional dimension B of rod 10. The blade is formed with two side edges 22 and 24, and an end edge 26. The end edge of the blade is a blunt square edge extending normal to rod axis 14. The blade end edge has a length dimension C that is approximately the same as rod cross-sectional dimension B.

Side edge 22 of the flat blade has a convex oviform (egg-shaped) shape designed to follow generally the concave interior surface of an oyster shell containing edible meat. A representative shell is designated by numeral 27 in FIG. 4. The other side edge 24 of the blade may be similarly shaped, although that edge contour is not so important. Cutting edge 22 preferably has an average radius of curvature about twice the blade width dimension E (FIG. 2). Blade edge 22 is preferable sharpened to a V-shape along its entire length to enhance its cutting capabilities.

In a representative implement the blade thickness dimension D is about 0.05 inch, the blade length dimension A is about 0.63 inch, the rod cross sectional dimension B is about 0.31 inch and the blade end edge length dimension C is about 0.25 inch. At a midpoint along the length of the blade the dimensional spacing E between the blade side edges is about 0.44 inch.

In use of the implement, it is moved in the direction of rod axis 14 so that blunt edge 26 of the blade is inserted into the hinged connection between the shells of an oyster. With the blade inserted about half way into the hinged connection the implement is turned around rod axis 14, such that the confronting edges of the oyster shells are spread apart to the blade dimension E. This action effectively separates the two shells from one another.

Figure 4:
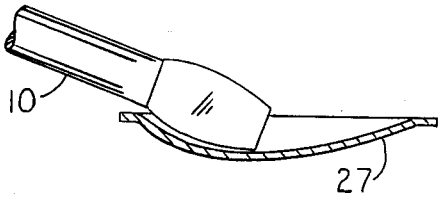
FIG. 4 is a fragmentary view showing the implement while in use to remove edible meat from an oyster shell.

FIG. 4 indicated in a broad sense how the implement can be used to remove edible meat from one of the oyster shells. The blade portion of the implement is inserted into the shell and moved along the shell interior surface with a scoop-like motion to sever the muscle connection between the meat and the shell. The convex oviform shape of cutting edge 22 enhances the cutting action and promotes a complete removal of the meat in one stroke of the implement.

In some respects my device resembles the device shown in Grush patent No. 4,477,943. However, in the Grush device end edge 16 of the blade is a pointed edge rather than a blunt square edge. The Grush device would have to be pushed a considerable distance into the hinged connection between the oyster shells before a blade twist dimension equivalent to blade twist dimension E could be realized. The Grush patent does not show my convex oviform cutting edge 22 that I have found to be effective for scooping the meat membrane from the oyster shell.

Colangelo patent No. 2,854,688 shows an implement having a shank 13 formed with an arcuate end 14. Convex edge 15 of the arcuate end 14 is sharpened; it is not clear from the Colangelo description how much of the arc 15 is sharpened, or exactly how the sharpened edge is used to remove meat from the shell. The relatively small radius of curvature of Colangelo's arcuate edge 15 would probably not conform to the interior surface contour on an oyster shell; the action of the Colangelo device is believed to be different than the scoop action that I contemplate using.

I claim:

1. A device for separating the shells of an oyster and removing the meat therein, comprising an elongated rod having a handle at one of its ends and a flat-surfaced blade extending from its other end on the rod axis; said blade having a length greater than the cross-sectional dimension of the rod; said flat blade having two side edges and an end edge; said end edge being a blunt square edge extending normal to the rod axis, said blunt edge having a length that is approximately the same as the rod cross sectional dimension, whereby the device can be moved in the direction of the rod axis to insert the blunt edge of the blade into a hinged muscle connection between the shells of an oyster, after which the device can be turned on the rod axis to enable the blade flat surfaces to break the hinged connection; at least one of the side edges of the flat blade having a convex oviform shape conforming generally to the concave interior surface of an oyster shell containing edible meat, whereby the blade can be drawn along the shell interior surface to permit said one side edge of the blade to sever the meat from the oyster shell; said convex oviform edge being sharpened along its length to enhance the blade cutting action.

2. The device of claim 1 wherein both side edges of the flat blade are of convex oviform shape; the side edges of the blade having a mid-point spacing that is substantially greater than the length of the blade end edge, whereby when the blade is inserted longitudinally into the hinged connection between the oyster shells the mid area of the blade will have a substantial blade surface presented to the confronting edges of the shell, such that a manual turning of the device around the rod axis will force the shell edges apart.

3. The device of claim 2 wherein the radius of curvature of said one side edge of the blade is approximately twice the mid-point spacing of the blade side edges.

4. The device of claim 3 wherein the blunt end edge of the blade is slightly shorter than the rod cross sectional dimension.

5. The device of claim 4 wherein the length of the end edge of the blade is at least five times the blade thickness.

6. The device of claim 5 wherein the blade length is about 0.63 inch, the mid-point spacing of the blade side edges is about 0.44 inch, the length of the blade end edge is about 0.25 inch, and the blade thickness is about 0.05 inch.

* * * * *